US010326228B2

(12) United States Patent
Yamanashi et al.

(10) Patent No.: US 10,326,228 B2
(45) Date of Patent: Jun. 18, 2019

(54) CONNECTOR HAVING TERMINAL WITH INSULATED TIP AND EDGES

(71) Applicant: Yazaki Corporation, Tokyo (JP)

(72) Inventors: Daisuke Yamanashi, Shizuoka (JP); Kenichi Okamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/005,484

(22) Filed: Jun. 11, 2018

(65) Prior Publication Data

US 2018/0358732 A1 Dec. 13, 2018

(30) Foreign Application Priority Data

Jun. 12, 2017 (JP) ..... 2017-115436

(51) Int. Cl.

| | |
|---|---|
| ***H01R 13/03*** | (2006.01) |
| ***H01R 13/44*** | (2006.01) |
| ***H01R 13/26*** | (2006.01) |
| *H01R 13/405* | (2006.01) |

(52) U.S. Cl.

CPC ..... *H01R 13/44* (2013.01); *H01R 13/03* (2013.01); *H01R 13/035* (2013.01); *H01R 13/26* (2013.01); *H01R 13/405* (2013.01)

(58) Field of Classification Search

CPC ..... H01R 13/03; H01R 13/035; H01R 13/04; H01R 13/629; H01R 13/6505; H01R 13/6599; H01R 4/58; H01R 39/20

See application file for complete search history.

(56) References Cited

U.S. PATENT DOCUMENTS

| | | | | |
|---|---|---|---|---|
| 2,537,370 A * | 1/1951 | Parnes | ..... | H01R 13/44 439/693 |
| 6,478,586 B1 * | 11/2002 | Ma | ..... | H01R 13/26 439/79 |
| 8,398,442 B2 * | 3/2013 | Yagi | ..... | H01R 13/04 439/181 |
| 10,027,044 B2 * | 7/2018 | Pavageau | ..... | G06K 7/0021 |

FOREIGN PATENT DOCUMENTS

JP 2015-83809 A 4/2015

* cited by examiner

*Primary Examiner* — Vanessa Girardi

(74) *Attorney, Agent, or Firm* — Kenealy Vaidya LLP

(57) ABSTRACT

Provided is a connector which can prevent slide-contact between an insulation part and a mating terminal while improving a human body contact prevention function. A tip end insulation part provided to an end face of a terminal fitting main body is receded with respect to a contact face which contacts with a mating terminal, thereby preventing the slide-contact between an insulation part and a mating terminal when connecting the connectors to each other. Further, a side insulation parts provided so as to sandwich the tip end insulation part in the Y direction are protruded with respect to the tip end insulation part, so a finger of an operator is unlikely to reach to the contact face, thereby improving the human body contact prevention function.

3 Claims, 5 Drawing Sheets

CONNECTOR HAVING TERMINAL WITH INSULATED TIP AND EDGES

CROSS REFERENCE TO RELATED APPLICATION

The priority application Japanese Patent Application No. 2017-115436 upon which this patent application is based is hereby incorporated by reference.

BACKGROUND

Field of the Invention

The present disclosure relates to a connector including a tubular housing and a terminal to be housed in the housing.

Description of the Related Art

Generally, an electrical device of an on-board device and such is provided with various connectors, and the electrical device is connected to an external device via the connectors to supply power to or transmit signal to the electrical device. As one example of such connector, there is proposed a connector to be provided to an electric throttle valve control device (for example, refer to Japanese Patent Application Publication No. 2015-83809 (hereinafter called "JP'809")). The connector disclosed in JP'809 is constituted of a tubular coupler (housing) formed on an outer face of a cover and a coupler terminal housed in the coupler.

SUMMARY OF THE INVENTION

However, as mentioned below, there is a drawback in the connector as disclosed in JP'809 in which the terminal is housed in the tubular housing with one end opened. That is, such connector may be required to have a configuration to prevent a finger of an operator and such from contacting a metal part of the terminal so as to satisfy International Protection code defined by a standard such as IEC60529, for example. One configuration may include making a distance from the opening end of the tubular housing to the tip end of the terminal to be long so the finger is unlikely to be reached to the terminal. However, such configuration causes an increase in the entire size of the connector.

Another configuration may include providing an insulation part at the tip end of the terminal so the finger does not directly contact the metal part. However, in case a connector in which a mating terminal shaped into an elastic piece is to be contacted to a band-shaped terminal fitting, the mating terminal slide-contacts (contacts in a sliding manner) on the insulation part when connecting the connectors to each other, possibly causing the insulation part to be shaved. It is possible to bring back the insulation part from the contact face of the terminal fitting (i.e., position the insulation part away from the mating terminal) to prevent the slide-contact with the mating terminal, however that would make the finger likely to reach to the contact face, resulting in a decrease in the human body contact prevention function.

An object of the present invention is to provide a connector which can prevent slide-contact between an insulation part and a mating terminal while improving a human body contact prevention function.

To achieve the above-mentioned object, the present invention provides a connector including a tubular housing having an opening at one end, and a terminal to be housed in the housing, wherein the terminal includes a band plate-shaped terminal fitting part and an insulation part, the terminal fitting part including a contact face to be contacted with a mating terminal and formed on at least one of a front face and a back face of the terminal fitting part, wherein the insulation part includes a tip end insulation part provided to an end face of the terminal fitting part located on the opening side, and side insulation parts provided so as to sandwich the tip end insulation part in a width direction, and wherein, in a direction perpendicular to a plane of the contact face, the tip end insulation part is receded with respect to the contact face, and the side insulation parts are protruded with respect to the tip end insulation part.

According to the connector of the present invention described above, the tip end insulation part provided to the end face of the terminal fitting main body is receded with respect to the contact face which contacts with the mating terminal, thereby preventing the slide-contact between the insulation part and the mating terminal when connecting the connectors to each other. Further, the side insulation parts provided so as to sandwich the tip end insulation part and the terminal fitting part in the width direction are protruded with respect to the tip end insulation part, so a finger of an operator is unlikely to reach to the contact face, thereby improving the human body contact prevention function.

DETAILED DESCRIPTION OF EXEMPLARY EMBODIMENT OF THE INVENTION

Figure 1:
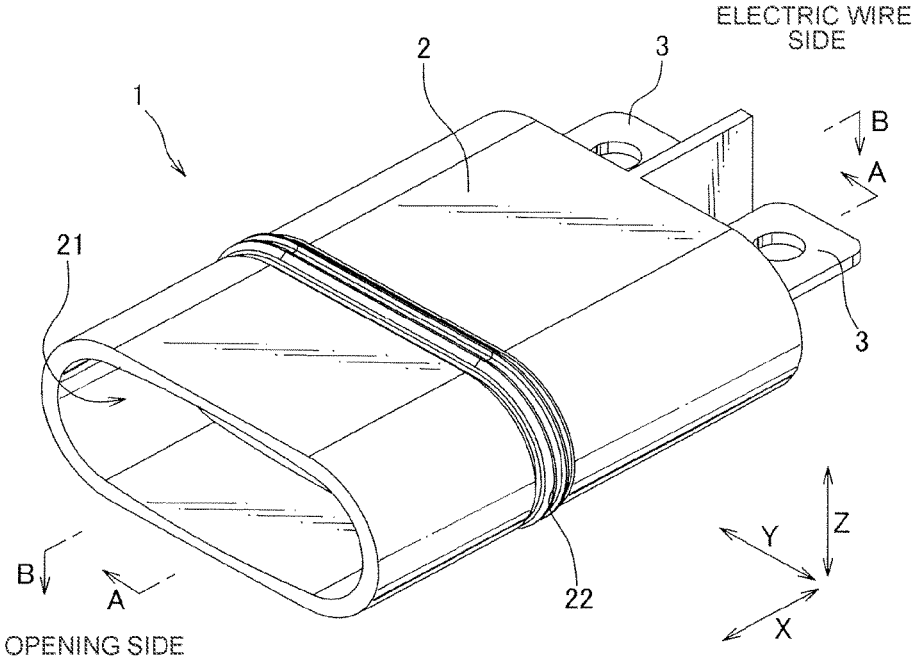
FIG. 1 is a perspective view showing a connector according to one embodiment of the present invention.
Figure 2:
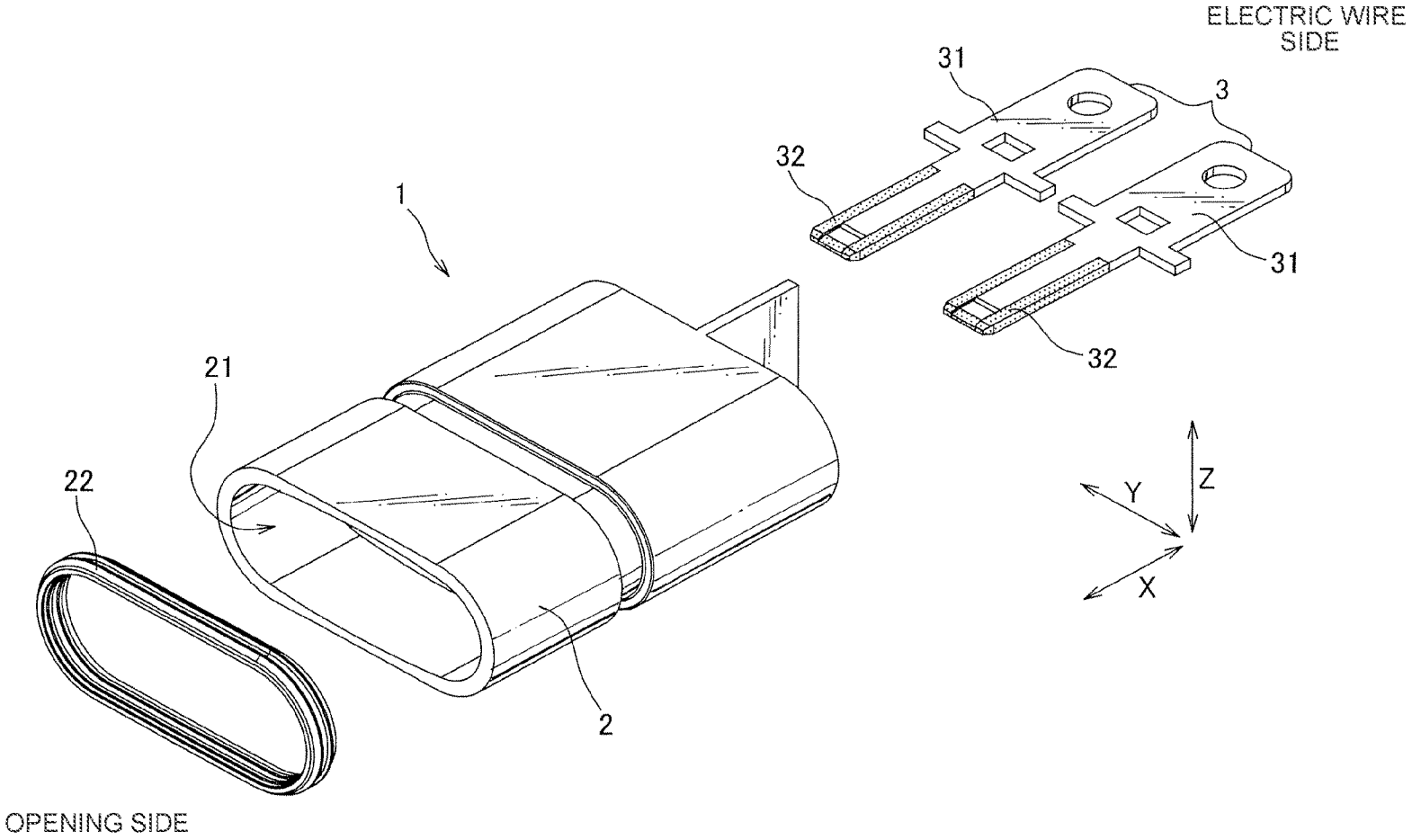
FIG. 2 is an exploded perspective view showing the connector.
Figure 3:
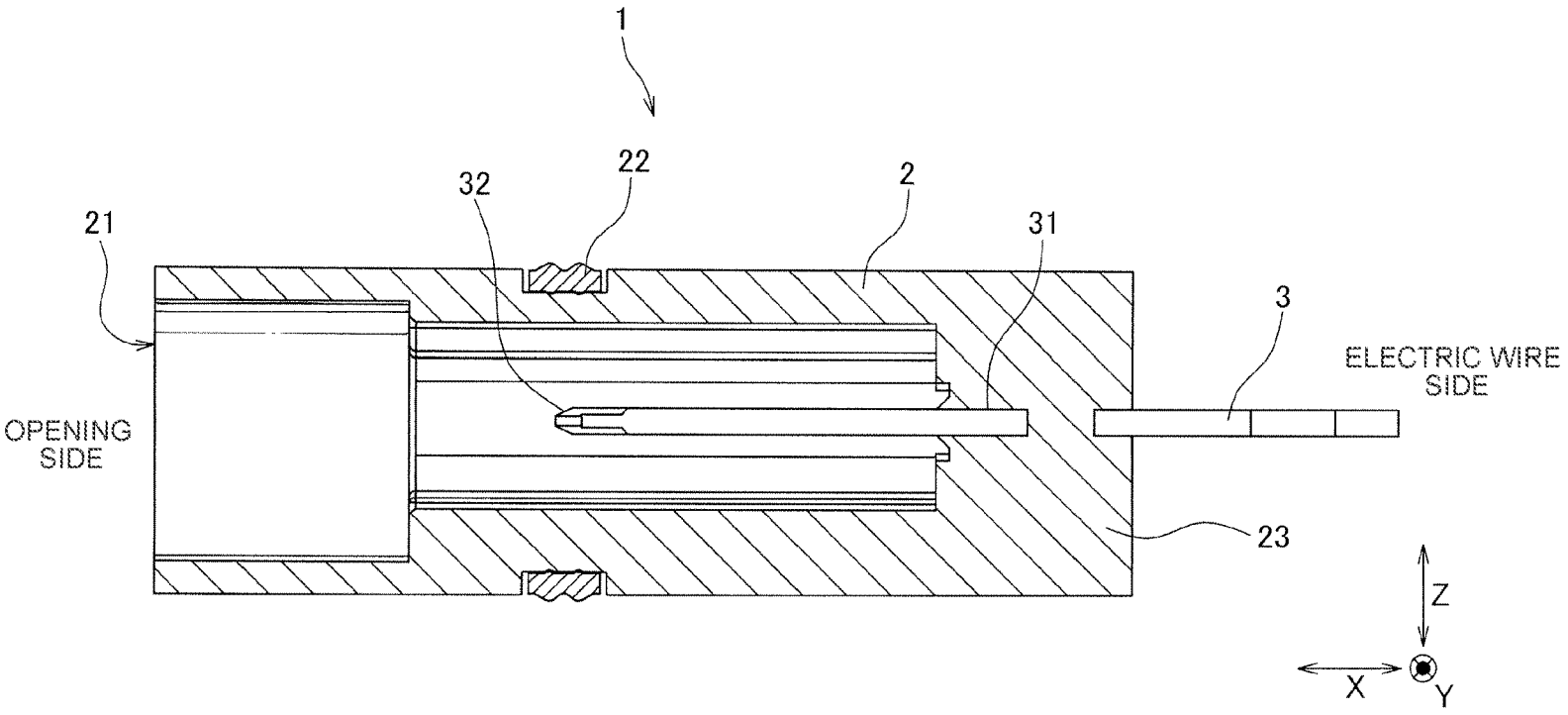
FIG. 3 is a cross-sectional view taken along a line A-A of FIG. 1.
Figure 4:
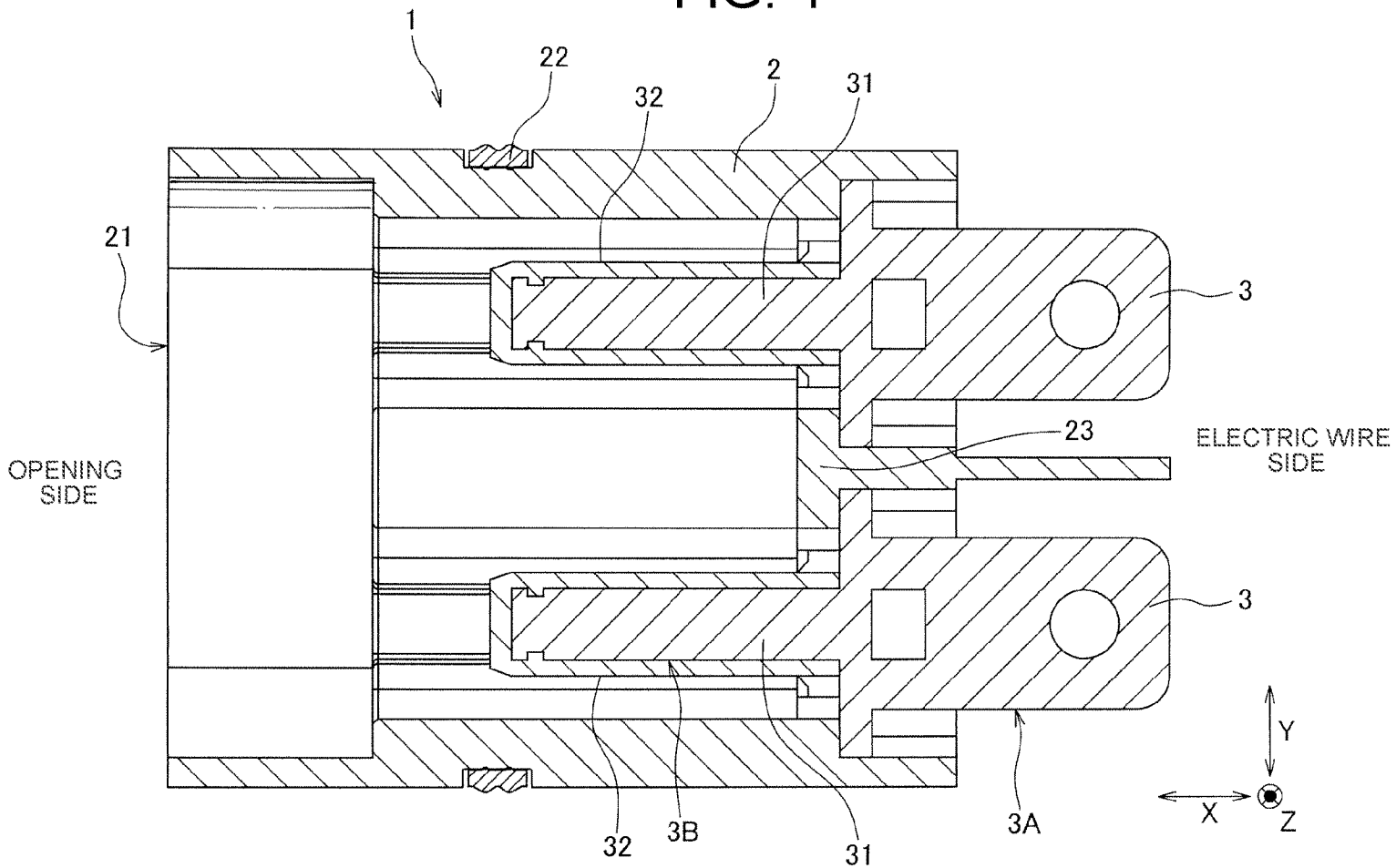
FIG. 4 is a cross-sectional view taken along a line B-B of FIG. 1.
Figure 5:
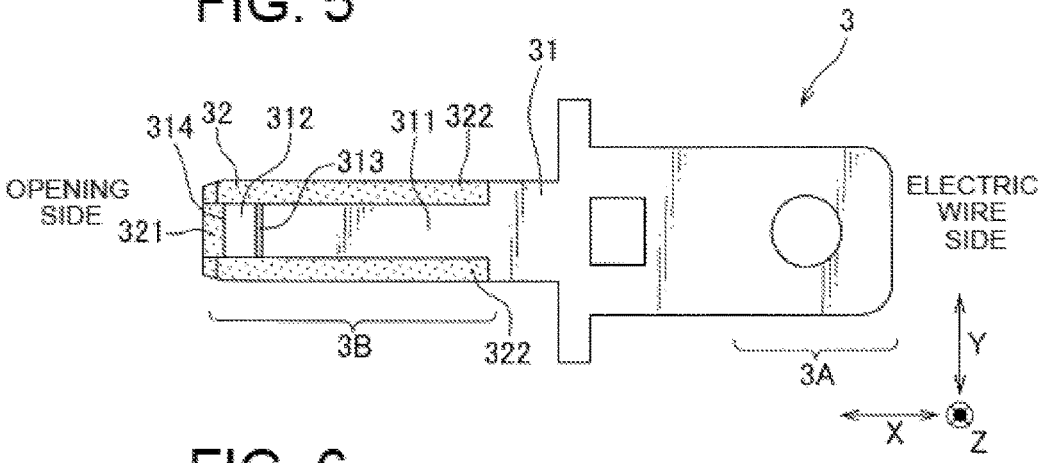
FIG. 5 is a planar view showing a terminal fitting of the connector.
Figure 6:
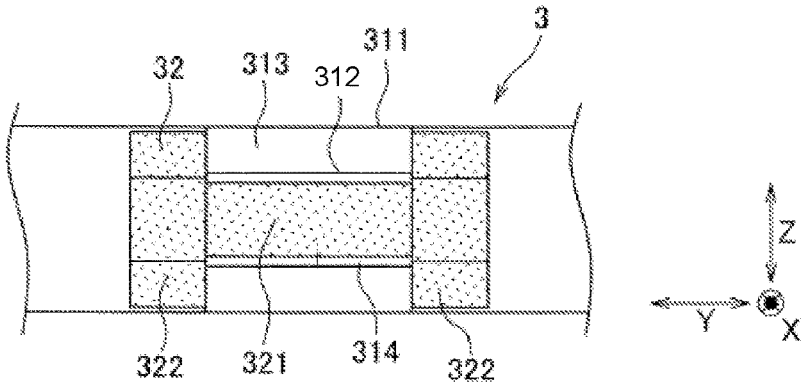
FIG. 6 is a front view of the terminal fitting.
Figure 7:
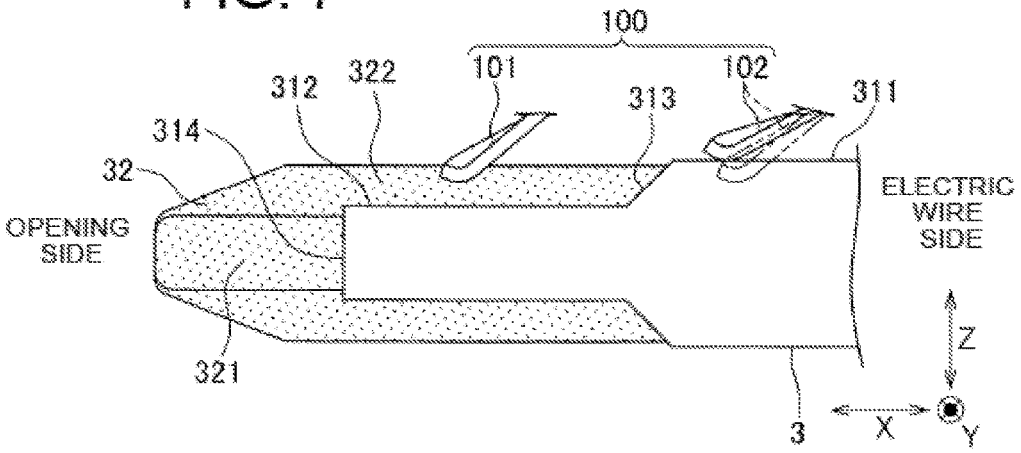
FIG. 7 is a cross-sectional view illustrating slide-contact between the terminal fitting and a mating terminal.

The following will explain an exemplary embodiment of the present invention in reference to the drawings. FIG. 1 is a perspective view showing a connector 1 according to one embodiment of the present invention, FIG. 2 is an exploded perspective view of the connector 1, FIG. 3 is a cross-sectional view taken along a line A-A of FIG. 1, FIG. 4 is a cross-sectional view taken along a line B-B of FIG. 1, FIG. 5 is a planar view showing a terminal 3 of the connector 1, FIG. 6 is a front view of the terminal 3, and FIG. 7 is a cross-sectional view illustrating slide-contact between the terminal 3 and a mating terminal 100.

The connector 1 according to this embodiment is for connecting on-board devices, such as a motor and an inverter, to each other. The connector 1 includes a tubular housing 2 having an opening 21 at its one end, and two terminals 3 housed in the housing 2. In this embodiment, an extending direction of the tubular housing 2 is referred to as a X direction, and two directions orthogonal to the X direction are referred to as a Y direction and a Z direction, respectively. Further, in the X direction, the opening 21 side of the housing 2 is referred to as "opening side", and the side opposite to the opening side is referred to as "electric wire side".

The housing 2 is formed of insulating resin and is formed into an oval shape with its longitudinal direction corresponding to the Y direction when viewed in the X direction. An annular packing 22 is provided to an outer circumferential face of the housing 2. An end of the housing 2 on the electric wire side in the X direction is closed by a wall part 23. The wall part 23 is formed integrally with the terminal 3.

A mating housing and the mating terminal 100 (refer to FIG. 7) are housed in an internal space of the tubular housing 2. The mating terminal 100 is constituted of a plurality of elastic pieces 101, 102, and is configured to contact and push a later-described contact face 311 by force directed from outside (i.e., a wall of the housing 2) toward inside (i.e., a central portion of the internal space) in the Z direction.

The two terminals 3 are aligned in the Y direction and have the same configuration. The terminal 3 includes a terminal fitting main body 31 and an insulation part 32 which are integrally formed using mold forming, for example.

The terminal fitting main body 31 is formed by a sheet metal, for example, and extends along the XY plane. The terminal fitting main body 31 includes an electric wire connection part 3A to be connected to an electric wire, and a terminal connection part 3B as a terminal fitting part to be connected to the mating terminal 100. In the connector 1, the terminal connection part 3B is housed in the housing 2, and the electric wire connection part 3A is protruded outside of the housing 2.

In the terminal connection part 3B, the terminal fitting main body 31 is formed into a rectangular band-plate shape with its long side corresponding to the X direction. The terminal fitting main body 31 may take other form as long as at least the terminal connection part 3B is formed into a band-plate shape. The contact faces 311 to be contacted with the mating terminal 100 are formed on both front and back faces of the terminal connection part 3B of the terminal fitting main body 31. One of the two contact faces 311 is to actually contact with the mating terminal 100, and either one of the two contact faces 311 may contact the mating terminal 100. Alternatively, the mating terminals 100 may be provided for both sides of the terminal fitting main body 31, and thus both of two contact faces 311 may contact with the mating terminals 100.

Receding faces 312 are formed on the both front and back faces of the terminal connection part 3B of the terminal fitting main body 31, and are located on the opening side in the X direction with respect to the contact faces 311. The receding faces 312 are receded with respect to the contact faces 311 in the Z direction (i.e., a direction perpendicular to a plane of the contact face 311). Herein, "receding" or "receded" has the opposite meaning of "protruding" or "protruded". That is, if the receding face 312 is regarded as a reference, then the contact face 311 is protruding in the Z direction. Thus, the plate thickness of the terminal fitting main body 31 is thinner in a region in which the receding faces 312 are formed than in a region in which the contact faces 311 are formed. A tapered face 313 is formed between the contact face 311 and the receding face 312 such that the tapered face 313 is receded gradually in the Z direction from the contact face 311 to the receding face 312.

The insulation part 32 includes a tip end insulation part 321 provided to an end face 314 of the terminal fitting main body 31 on the opening side in the X direction, and two side insulation parts 322 provided so as to sandwich the tip end insulation part 321 and the terminal connection part 3B in the Y direction (i.e., in the width direction). The tip end insulation part 321 and the side insulation parts 322 communicate with each other on the opening side in the X direction.

In this embodiment, the both front and back faces of the tip end insulation part 321 are slightly receded in the Z direction more than the receding faces 312 for convenience of molding (i.e., slightly receded with respect to the receding faces 312), but they may be positioned on substantially the same plane as the receding faces 312. Further, the both front and back faces of the tip end insulation part 321 are receded in the Z direction with respect to the contact faces 311.

The side insulation parts 322 are extended to a position that the insulation parts 322 sandwich not only the region of the terminal fitting main body 31 in which the receding faces 312 are formed, but also the region of the terminal fitting main body 31 in which the contact faces 311 are formed. Thus, the side insulation parts 322 are extended over the entire region which is to be housed in the housing 2. Both front and back faces of the side insulation part 322 are arranged on substantially the same plane as the contact faces 311 or arranged slightly receded with respect to the contact faces 311, and are protruded with respect to the tip end insulation part 321 in the Z direction. In this embodiment, the side insulation part 322 includes a tapered shape on the opening side in the X direction, such that its dimension in the Z direction decreases as it gets towards the opening side. However, such tapered portion may not be formed. The insulation part 32 having the tip end insulation part 321 and the two side insulation parts 322 as described above is formed into an H-like shape when viewed from the X direction, and includes two grooves opened in the Z direction.

Next, the positional relationship of the terminals when fitting the connector 1 to the mating connector will be explained. Herein, the dimension in the Y direction of the elastic piece 101, 102 of the mating terminal 100 is equal to or smaller than the dimension in the Y direction of the contact face 311, so the elastic pieces 101, 102 do not stick out from the contact face 311 in the Y direction. The elastic piece 101 which passes through the region of the terminal 3 in which the tip end insulation part 321 and the receding faces 312 are formed does not contact or slide-contact with any of the tip end insulation part 321 and the receding faces 312.

On the other hand, the elastic piece 102 which passes through the region of the terminal 3 in which the contact face 311 is formed contacts and slide-contacts with the contact face 311. The elastic piece 102 that has contacted the contact face 311 is elastically deformed and thereby pushes the contact face 311. The papered face 313 is formed between the contact face 311 and the receding face 312, thus the elastic piece passing through this tapered face 313 is gradually deformed. As described above, since the elastic piece does not stick out from the contact face 311, it does not contact or slide-contact with the side insulation parts 322.

Once the connectors are fitted to each other, all of the elastic pieces of the mating terminal 100 are passed through the regions in which the tip end insulation part 321 and the receding faces 312 are formed, and contact with the contact face 311.

The present invention according to this embodiment has the following advantageous effects. That is, since the tip end insulation part 321 provided to the end face 314 of the terminal fitting main body 31 is slightly receded with respect to the contact face 311 which contacts with the mating terminal 100, the slide-contact between the insulation part 32 and the mating terminal 100 can be prevented when connecting the connectors to each other. Further, since the side insulation parts 322 provided so as to sandwich the tip end insulation part 321 in the Y direction are protruded with respect to the tip end insulation part 321, the finger of the operator is unlikely to reach to the contact face 311, thereby improving the human body contact prevention function.

Furthermore, since the terminal fitting main body 31 and the insulation part 32 are integrally formed, the number of components of the connector 1 can be reduced.

Furthermore, since the terminal fitting main body 31 includes the receding face 312 receded with respect to the contact face 311, even if burrs are produced at a boundary face between the tip end insulation part 321 and the end face 314 during the integral molding of the terminal fitting main body 31 and the insulation part 32, the slide-contact between the insulation part 32 and the mating terminal 100 can be prevented. That is, even if the produced burrs are protruded from the receded face 312 in the Z direction, since the receded face 312 is receded with respect to the contact face 311, these burrs are unlikely to contact with the mating terminal 100.

Furthermore, since the two side insulation parts 322 sandwich the terminal connection part 3B in the Y direction over the whole of the region of the terminal fitting main body 31 which is to be housed in the housing 2, the insulation property between the two terminals 3 aligned in the Y direction can be improved. As a result, the terminals 3 can be disposed close to each other so the entire size of the connector 1 can be reduced.

The present invention is not limited to the embodiments described above. The present invention may include other constitutions which can achieve the object of the present invention, and, modifications and such as described below is also within the present invention.

For example, in the embodiment described above, the terminal fitting main body 31 and the insulation part 32 are integrally molded. However, they can be formed in separate pieces. That is, the insulation part may be formed into a cap-like shape and attached to the terminal fitting part.

Further, in the embodiment described above, the terminal fitting main body 31 includes the receding face 312 receded with respect to the contact face 311. However, the receding face may be omitted in case the burrs are unlikely to be produced during molding the insulation part, or the burrs can be removed adequately, or the burrs are unlikely to contact with the mating terminal.

Furthermore, in the embodiment described above, the contact faces 311 are formed on the both front and back faces of the terminal connection part 3B of the terminal fitting main body 31. However, the contact face which contacts with the mating terminal may be formed on only one of the front and back faces. Further, in case the contact face is formed only on one face, then receding face should be formed on the same face with the contact face.

Furthermore, in the embodiment described above, the side insulation parts 322 are extended over the whole of the region of the terminal fitting main body 31 which is to be housed in the housing 2 (i.e., the terminal connection part 3B). However, the side insulation part 322 may be configured in an alternative manner, as long as the side insulation part is provided at a position sandwiching at least the tip end insulation part in the width direction. In case the side insulation part is provided only to the tip end portion of the terminal fitting main body 31, the insulation property between the terminals can be ensured in a suitable manner, for example by providing a wall made of insulating resin between the two terminals, or by increasing the distance between the terminals.

The preferred constitution and method for implementing the present invention have been disclosed herein, however the present invention is not limited to these. That is, although the present invention is shown and explained with reference to some particular embodiments, a skilled person in the art will understand that various modifications related to shape, material, number and other detailed constitutions may be applied to the embodiments described herein without departing from the range of technical idea and the object of the present invention. Therefore, since those descriptions specifying the shape, material and such disclosed herein are described by way of examples to facilitate the understanding of the present invention and do not limit the present invention, the descriptions of members using names without a part or entire of such limitations of shape, material and such are within the present invention.

LIST OF REFERENCE SIGNS

1 connector
2 housing
21 opening
3 terminal
3B terminal connection part (terminal fitting part)
311 contact face
312 receding face
32 insulation part
321 tip end insulation part
322 side insulation part
100 mating terminal

What is claimed is:

1. A connector comprising:

a tubular housing having an opening at one end; and a terminal housed in the housing, wherein the terminal includes a band plate-shaped terminal fitting part and an insulation part, the terminal fitting part including a contact face to be contacted with a mating terminal and formed on at least one of a front face and a back face of the terminal fitting part, wherein the terminal fitting part of the terminal is entirely housed in the housing, wherein the insulation part includes a tip end insulation part provided to an end face of the terminal fitting part located on the opening side, and side insulation parts provided so as to sandwich the tip end insulation part in a width direction, wherein, in a direction perpendicular to a plane of the contact face, the tip end insulation part is receded with respect to the contact face, and the side insulation parts are protruded with respect to the tip end insulation part, and the contact face extends between the side insulation parts and is exposed between the side insulation parts.

2. The connector according to claim 1, wherein the terminal fitting part and the insulation part are formed integrally.

3. The connector according to claim 2, wherein the terminal fitting part includes a receding face located on the opening side with respect to the contact face, the receding face receded with respect to the contact face in the direction perpendicular to the plane of the contact face.

* * * * *